United States Patent [19]

Pollack

[11] 4,374,707

[45] Feb. 22, 1983

[54] ORIFICE PLATE FOR INK JET PRINTING MACHINES

[75] Inventor: Joel M. Pollack, Rochester, N.Y.

[73] Assignee: Xerox Corporation, Stamford, Conn.

[21] Appl. No.: 245,422

[22] Filed: Mar. 19, 1981

[51] Int. Cl.[3] ..... C25D 1/08; C25D 1/20

[52] U.S. Cl. ..... 204/11; 204/24

[58] Field of Search ..... 204/11, 24

[56] References Cited

U.S. PATENT DOCUMENTS

| | | | |
|---|---|---|---|
| 3,192,136 | 6/1965 | Reid | 204/11 |
| 3,449,221 | 6/1969 | Thomas | 204/11 |
| 3,701,998 | 10/1972 | Mathis | 346/75 |
| 3,726,770 | 4/1973 | Futterer | 204/16 |
| 3,949,410 | 4/1976 | Bassous | 346/75 |
| 4,007,464 | 2/1977 | Bassous | 346/75 |
| 4,031,561 | 6/1977 | Paranjpe | 346/1 |
| 4,033,831 | 7/1977 | Bakewell | 204/11 |
| 4,058,432 | 11/1977 | Schuster-Woldan | 156/659 |
| 4,139,434 | 2/1979 | Dugan | 204/24 |
| 4,184,925 | 1/1980 | Kenworthy | 204/11 |
| 4,229,265 | 10/1980 | Kenworthy | 204/11 |

OTHER PUBLICATIONS

IBM Tech. Disclosure Bulletin, vol. 21, No. 11, Apr. 1979, p. 4589.

*Primary Examiner*—T. M. Tufariello

*Attorney, Agent, or Firm*—H. Fleischer; J. E. Beck; R. Zibelli

[57] ABSTRACT

An orifice plate for use in ink jet printing machines is produced by an electroplating technique. The plate is bilaminar with nickel being plated onto copper to form a substantially rigid structure.

15 Claims, 2 Drawing Figures

ORIFICE PLATE FOR INK JET PRINTING MACHINES

Figure 1:
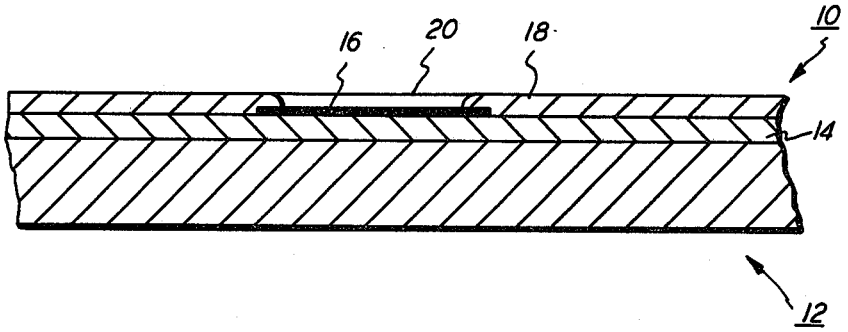

This invention relates generally to ink jet printing machines, and more particularly concerns an orifice plate for use therein.

In ink jet printing systems, a jet of ink is formed by forcing ink under pressure through a nozzle. The jet of ink can be made to break up into droplets of substantially equal size and spacing by vibrating the nozzle or by otherwise creating a periodic pressure or velocity perturbation on the jet, preferably in the vicinity of the nozzle orifice. Printing is effected by controlling the flight of the droplets to a target such as paper. Significant characteristics of ink jet printing applications are the size of respective nozzles, spacial distribution of the nozzles in an array and the technique for creating the periodic perturbations on the jet. Such factors affect the velocity uniformity of the fluid emitted from the respective nozzle, directionality of the respective droplets, and breakoff distance of individual droplets.

One of the critical requirements in an ink jet printing machine is the orifice plate which will produce several hundred jets of ink which are precisely positioned, precisely parallel, and precisely uniform. The orifice plate must also be compatible with the ink compositions used, and must be resistant to corrosion by the ink. Hereinbefore, orifice plates were fabricated by using electroforming techniques. This approach yielded orifices with acceptable accuracy but which were difficult to mount. By the nature of this process, holes are adequately formed in materials of less than two mils thick. Generally, nickel, which exhibits high tensil strength, is utilized. However, nickel is very flexible. The orifice plate is desirably rigid and thin to define a plane for the orifices.

Various approaches have been devised for constructing thin plates. The following disclosures appear to be relevant to ink jet printing systems:

U.S. Pat. No. 3,701,998, Patentee: Mathis. Issued: Oct. 31,1972.

U.S. Pat. No. 3,726,770. Patentee: Futterer. Issued: Apr. 10, 1973.

U.S. Pat. No. 3,949,410. Patentee: Bassous et al. Issued: Apr. 6, 1976.

U.S. Pat. No. 4,007,464. Patentee: Bassous et al. Issued: Feb. 8, 1977.

U.S. Pat. No. 4,031,561. Patentee: Paranjpe. Issued: June 21, 1977.

U.S. Pat. No. 4,058,432. Patentee: Schuster-Woldan et al. Issued: Nov. 15, 1977.

U.S. Pat. No. 4,184,925. Patentee: Kenworthy. Issued: Jan. 22, 1980.

IBM Technical Disclosure Bulletin. Vol. 21, No. 11. Author: Gould, Jr. Date: April, 1979.

The relevant portions of the foregoing disclosures may be briefly summarized as follows.

Mathis discloses a jet drop recorder having a recording head comprising an orifice plate attached to a fluid supply manifold. The orifice plate is preferably formed of a relatively stiff material such as stainless steel or nickel coated berylium-copper but is relatively thin to provide the required flexibility for direct contact stimulation.

Futterer describes a process for producing a master negative suitable for the production of a number of perforated foils. An alkali resistant metal base plate is covered with a pattern of areas of insulating material, also stable in an alkali bath. The unit is then suspended in an acid tin bath. A thin coating is applied by electroplating the free areas of the metal base plate. The surface of the tin coating is passivated in a bichromate solution and rinsed in clear water. The master negative is then placed in an electrolytic bath for depositing a perforated foil of nickel thereon. The areas of insulating material may be formed by etching the metal base plate and filling the etched layers with insulating material.

Bassous et al. ('410) discloses a jet nozzle for use in ink jet printing. A small recess is chemically etched into the surface of a single crystalline silicon wafer. Thereafter, a $P^+$ layer is diffused into the layer except for a portion thereof which is masked during the diffusion. A pyramidal opening is chemically etched on the entrance side of the crystal wafer with the orifice region being concomitantly etched. The wafer is oxidized to form an insulation layer therein. This converts the $P^+$ membrane to a silicon dioxide membrane.

Bassous et al. ('464) describes a process for producing an aperture in a single crystal wafer to form a jet nozzle or an array of such jet nozzles. The polished silicon wafer is cleaned and oxidized to form a silicon dioxide film. The oxidized wafer is then coated on opposed sides with a photoresist material. A nozzle base hole pattern is exposed and developed in the photoresist layer. The silicon dioxide layer in the opening is etched away. The photoresist is then removed from both sides of the wafer and a silicon dioxide film grown over the surface of the wafer.

Paranjpe discloses a jet drop recorder including an orifice plate having two rows of orifices which create two rows of drop streams. The orifice plate is soldered or otherwise bonded to an orifice plate holder mounted within a manifold block to create a cavity for holding a supply of electrically conductive ink.

Schuster-Woldan et al. describes a process for producing a metal grid with a supporting frame. A thin layer of photopolymer material is applied on the metal carrier. A photolithographic process is employed to produce a galvanic resistant coating. The metal grid is formed by galvanic path depositing metal on portions of the metal carrier not protected by the photopolymeric material. After the metal grid is formed, the photopolymeric material is removed and an etch resistant covering applied to the edges of the carrier. The carrier is then selectively etched away to leave the metal grid firmly attached thereto along the border regions.

Kenworthy discloses a plating technique for fabricating an orifice plate for a jet drop recorder. A sheet of stainless steel is coated on both sides with a photoresist material. The photoresist is then exposed through suitable masks and developed to form cylindrical photoresist peg areas on both sides of the sheet. Nickel is then plated on the sheet until the height thereof covers the peg edges. A larger diameter photoresist plug is then formed over each photoresist peg. Nickel plating is then continued until the height is level with the plug. The photoresist and plate are then dissolved and peeled from the nickel forming two solid homogeneous orifice plates.

Gould, Jr. describes ink pumps having a brass mandrel coupled to an aluminum mandrel and nickel or nickel plated bellows. After forming the bellows, the aluminum mandrel is exposed and etched away.

In accordance with the present invention, there is provided a method of producing an orifice plate for use in ink jet printing systems. A substrate is attached to a support plate with a pattern of electrically insulated areas being formed on the surface of the substrate opposed to the support plate. The uninsulated areas of the surface of the substrate opposed to the support plate are electrical plated and the substrate separated from the support plate. Thereafter, the selected areas of the substrate are removed to produce the orifice plate.

Figure 2:
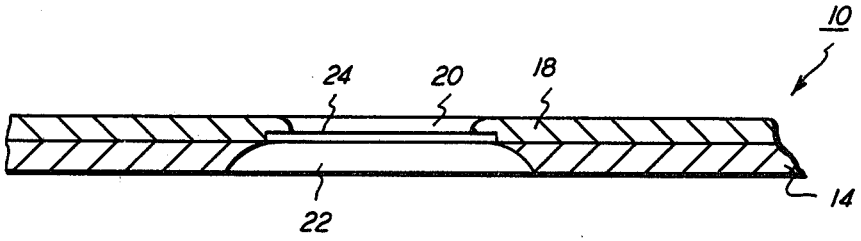

Other aspects of the present invention will become apparent as the following description proceeds and upon reference to the drawings, in which:

FIG. 1 is a sectional elevational view showing electroplating of the orifice plate; and FIG. 2 is a sectional elevational view depicting the fabricated orifice plate.

While the present invention will hereinafter be described in connection with a preferred method of construction, it will be understood that it is not intended to limit the invention to that method of construction. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. The drawings schematically depict the process for forming the orifice plate of the present invention. It will become apparent from the following discussion that the orifice plate may be formed by other approaches and is not necessarily limited to the particular method of construction shown herein.

As shown in FIG. 1, orifice plate 10 is formed by first selecting a suitable support plate 12, such as a plate of stainless steel. This stainless steel plate may be as thick as necessary to insure that it will remain flat and true. A copper substrate 14 is attached to support plate 12. Copper substrate 14 may be secured to support plate 12 by having the marginal regions outside of the area of the orifice plate itself, attached by adhesive to support plate 12. Alternatively, it may be fastened by threaded screws or other suitable means. Copper substrate 14 is then coated in known fashion with a photoresist material, which is exposed through a suitable mask to form a pattern of cylindrical areas 16 on the side of copper substrate 14 opposed from support plate 12. Cylindrical areas 16 remain on copper substrate 14 after the photoresist is developed and the unexposed resist washed away.

Copper substrate 12 is then plated with nickel 18 to form a lamellar layer thereon. Nickel is preferred since it provides adequate strength and when overcoated with a gold alloy, is compatible with current ink compositions used in ink jet printing systems, thereby reducing corrosion of the orifices to a minimum. The plating may be done, for example, by electroplating the substrate 14 in a suitable solution. During such an electroplating process, the nickel 18 is formed on the areas of substrate 14 which are conductive. Thus, no nickel plates on top of cylindrical areas 16. As the nickel plate 18 reaches and plates above the top of cylindrical area 16, the plating begins to creep inwardly across the top edges of cylindrical area 16, since the nickel around the edges of cylindrical area 16 is conductive, inducing plating in a radial direction across the top of the cylindrical area as well as in the outwardly direction away from substrate 14. The plating is continued until the opening over cylindrical areas 16 has been closed by the nickel to the exact diameters desired for forming and defining orifice 20 in orifice plate 10. Preferably, copper substrate 14 is about 90 mils thick with nickel layer 18 being about 1 mil thick.

Next, orifice plate 10, i.e. copper substrate 14 and nickel plating 18 are removed from metal support 12. With continued reference to FIG. 2, a sheet of photoresist material is laminated to the side of copper substrate 14 opposed from nickel plating 18. The laminated sheet of photoresist material is exposed through suitable masks to form a series of cylindrical areas substantially co-axial with orifices 20 in nickel plating 18. The cylindrical areas are the non-exposed and non-developed areas of the photoresist sheet laminate. Thus, only the cylindrical areas of the laminated sheet of resist will be subsequently dissolved and washed away. After applying the etch resistance photoresist to the selected areas of the copper, the copper substrate is selectively etched away in all areas except the areas which are protected by the photoresist. After etching, any resist remaining on orifice plate 10 is dissolved and washed away.

To selectively etch copper substrate 14, without attacking nickel substrate 18, the etching is accomplished with a selective etching agent. Etching agents of this type are used for example in the production of evaporative masks in accordance with the substrative technique and described in relevant literature. For example, an ammonia sodium-chloride etching agent attacks only copper and will not attack nickel. Exit port 22 is of a larger diameter than entrance port 24 of orifice 20. In this way, a pair of co-axial cylinders define orifice 20.

In addition to forming the orifices in plate 10, holes for mounting the plate to the ink drop generator can be incorporated in a similar manner. Moreover, if desired, a pattern of O-ring grooves may also be formed on plate 10. Upon completion of the entire structure, orifice plate 10 is passivated by gold plating. This further insures that orifice plate 10 resists chemical and electrochemical attack by the ink employed in the ink jet printing system.

One skilled in the art will appreciate that while copper has been described as the substrate other suitable materials such as brass may be employed in lieu thereof.

In recapitulation, the orifice plate of the present invention is formed by a process of electroplating a nickel layer onto a copper substrate secured to a support plate. Orifices are selectively formed in this bilaminar structure by chemically etching selected areas of the copper to form holes therein substantially co-axial with the apertures in the nickel layer. Thereafter, the entire plate is passivated by being gold plated. In this manner, a substantially rigid highly accurate orifice plate is fabricated.

It is, therefore, apparent that there has been provided in accordance with the present invention, a bilaminar orifice plate which fully satisfies the aims and advantages hereinbefore set forth. While this invention has been described in conjunction with a specific method of fabrication thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. A method of producing an orifice plate for use in an ink jet printing system, including the steps of:

providing a thin substrate attached to a thick support;

forming a pattern of electrically insulated areas on the surface of the substrate opposed to the support;

electroplating the uninsulated areas of the surface of the substrate opposed to the support;

separating the substrate from the support;

forming a pattern of chemically resistant areas on the nonelectroplated surface of the substrate to protect selected areas thereof; and dissolving the non-protected areas of the substrate to produce an orifice plate.

2. A method according to claim 1, wherein said step of electroplating includes the step of electroplating inwardly across the top edges of the insulated areas.

3. A method according to claim 2, wherein said step of forming electrically insulated areas includes the step of forming cylindrical areas of electrical insulation.

4. A method according to claim 3, wherein said step of forming chemically resistant areas includes the step of forming non-chemically resistant cylindrical areas having a diameter greater than the diameter of the areas of electrical insulation.

5. A method according to claim 4, wherein said step of electroplating includes the step of electroplating with a material other than the substrate material to form a non-homogeneous orifice plate.

6. A method according to claim 5, wherein said step of providing includes the step of securing a copper substrate to a metal support plate.

7. A method according to claim 5, wherein said step of providing includes the step of securing a brass substrate to a metal support plate.

8. A method according to claims 6 or 7, wherein said step of electroplating includes the step of electroplating with nickel to form a bilaminar orifice plate.

9. A method according to claim 8, wherein said step of forming chemically resistant areas includes the steps of:

laminating a sheet film of resist to the non-electroplated surface of the substrate;

exposing the resist to form a pattern of non-exposed circular areas thereon;

developing the exposed areas of the resist; and dissolving the non-exposed areas of resist.

10. A method according to claim 9, wherein said step of dissolving the non-protected areas of the substrate includes etching the non-protected areas of the substrate to form circular apertures in the substrate substantially co-axial with the cylindrical areas in the nickel electroplated thereon.

11. A method according to claim 10, wherein said step of electroplating with nickel includes the step of electroplating a 1 mil thick layer of nickel on a 90 mil thick substrate.

12. A method according to claim 1, further including the step of passivating at least the electroplated material with a material chemically resistant to the ink composition used in the ink jet printing system.

13. A method according to claim 12, wherein said step of passivating includes the step of passivating with a gold alloy.

14. A method according to claim 1, further including the step of forming at least one groove in the substrate suitable for receiving a sealing member therein.

15. A bilaminar orifice plate produced by the method of claim 1.

* * * * *